US005784862A

United States Patent [19]

Germano

[11] Patent Number: 5,784,862

[45] Date of Patent: Jul. 28, 1998

[54] DEVICE FOR THE PACKING UNDER VACUUM OF PRODUCTS CONTAINED IN FLEXIBLE BAGS

[76] Inventor: Maina Germano, Via Rossini, 3 - 20096 Pioltello (Milan), Italy

[21] Appl. No.: 589,537

[22] Filed: Jan. 22, 1996

[30] Foreign Application Priority Data

Jan. 27, 1995 [IT] Italy ..... MI950048 U

[51] Int. Cl.[6] ..... B65B 31/00

[52] U.S. Cl. ..... 53/512; 53/390

[58] Field of Search ..... 53/434, 512, 390

[56] References Cited

U.S. PATENT DOCUMENTS 3,832,824 9/1974 Burrell ..... 53/434

4,941,310 7/1990 Kristen ..... 53/434

5,044,142 9/1991 Gianelli ..... 53/434

5,239,808 8/1993 Wells et al. ..... 53/512

5,331,789 7/1994 Cur et al. ..... 53/434

*Primary Examiner*—Linda Johnson

*Assistant Examiner*—John Paradiso

*Attorney, Agent, or Firm*—Notaro & Michalos PC

[57] ABSTRACT

Device for the packing under vacuum of products contained in flexible bags in plastic material, creates around the opening of the bag, an airtight chamber connected to a removable air suction devices. Welding devices are suitable to weld the bag walls along a line beyond the chamber, in order to seal the bag after creating the vacuum inside it through the suction device.

4 Claims, 5 Drawing Sheets

DEVICE FOR THE PACKING UNDER VACUUM OF PRODUCTS CONTAINED IN FLEXIBLE BAGS

FIELD AND BACKGROUND OF THE INVENTION

This innovation proposes a device for the packing under vacuum of products contained in flexible bags, in particular in bags of plastic material, that includes means suitable to define, around the opening of the bag, an airtight chamber connected to devices for the suction of the air and means suitable to weld the walls of the bag along a line beyond this airtight chamber, in order to seal the bag after creating the vacuum inside it.

It is in particular a device conceived for home use and it is provided to be used in union with a suction device for the creation of the vacuum inside containers shown in the European patent application no 510360.

This patent includes a group engine-pump and the related feeding batteries located inside one covering, which is on its turn provided with a metal point that allows to connect it with receptacles provided with an airtight valve in order to suck air from inside and create in this way the vacuum.

The aspirator is not the subject of the invention, so that a detailed description of it is needless, as it can be found in the above mentioned European patent application.

The device according to the innovation has little dimensions, is easy to use and is extremely handy and practical to use, as it allows to create the vacuum inside bags and then seal them with few simple operations.

Many techniques are known for the preservation of products, in particular foodstuffs, and among them the use of vacuum is particularly advantageous.

For this purpose, foodstuffs are introduced into containers or bags, where vacuum is created, and afterwards they are sealed with different techniques.

At present this preservation technique under vacuum is limited to industrial use, as the devices that allow to suck the air from containers and then seal them are complex, expensive, with great dimensions and suitable only for specific industrial use. Also devices are known which are used for sealing bags in plastic material. They include a warmed blade, for instance by means of an electric resistance, through which the two opposite walls of the bags are sealed in order to close them.

SUMMARY OF THE INVENTION

The present invention is a device conceived in particular for home use, which allows both to create vacuum inside soft bags, in particular bags in plastic material, and to seal them, welding their walls near the open edge.

The device, to be used in union with a suction device, preferably a device of the type described in the European patent application no 510360, is provided with means suitable to create, around the opening of the bag, an airtight chamber connected to this suction device and provided with means for sealing suitable to weld the walls of the bag along a line beyond said chamber, in order to seal the bag in correspondence of the opening after creating the vacuum inside it.

BRIEF DESCRIPTION OF THE DRAWINGS

This innovation is now described in details, with reference to the enclosed figures, where.

DESCRIPTION OF THE PREFERRED EMBODIMENT

Figure 1:
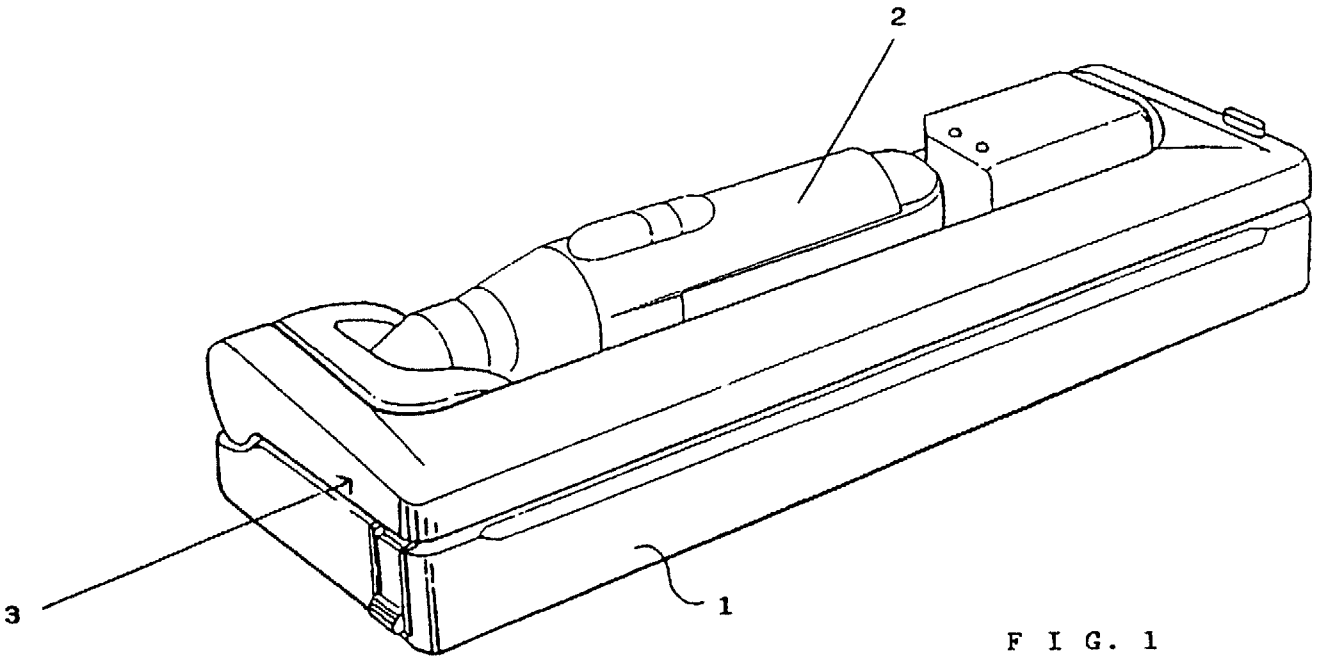
FIG. 1 represents, schematically, the device, in perspective view, with the mobile element in closed position.
Figure 2:
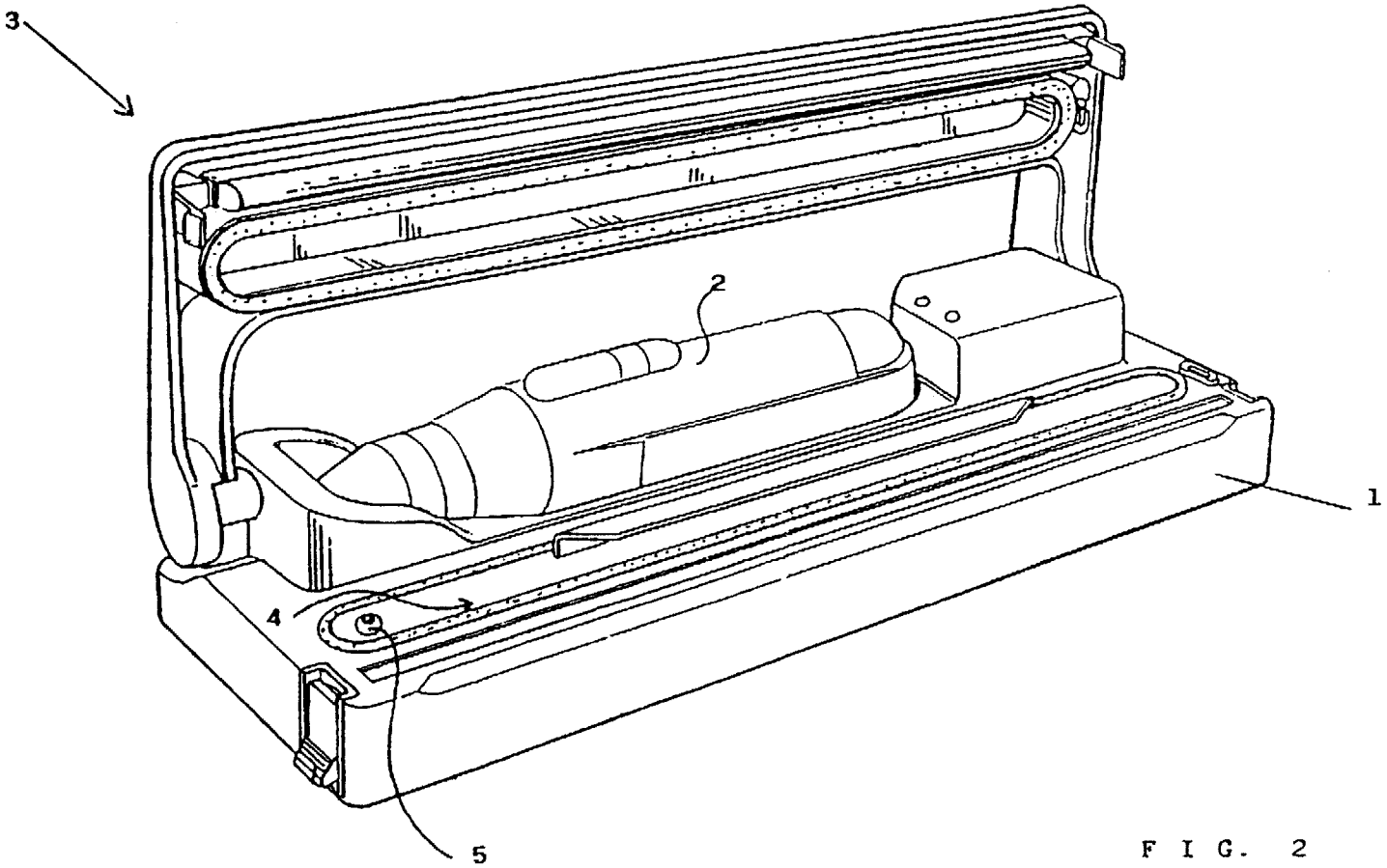
FIG. 2 represents the device in perspective view, with the mobile element lifted superiorly to the base structure.

With reference to FIGS. 1 and 2, the device according to the innovation includes a base 1 where a seat is obtained in order to house, in a removable way, a suction device 2, for instance of the type described in the European patent application no 510360.

A closing cover is fastened for pivoting to the base, shown in the whole with 3. Between the base 1 and the cover 3, the opening of the bag to seal is inserted, inside which first the vacuum is created in the way described below.

Figure 8:
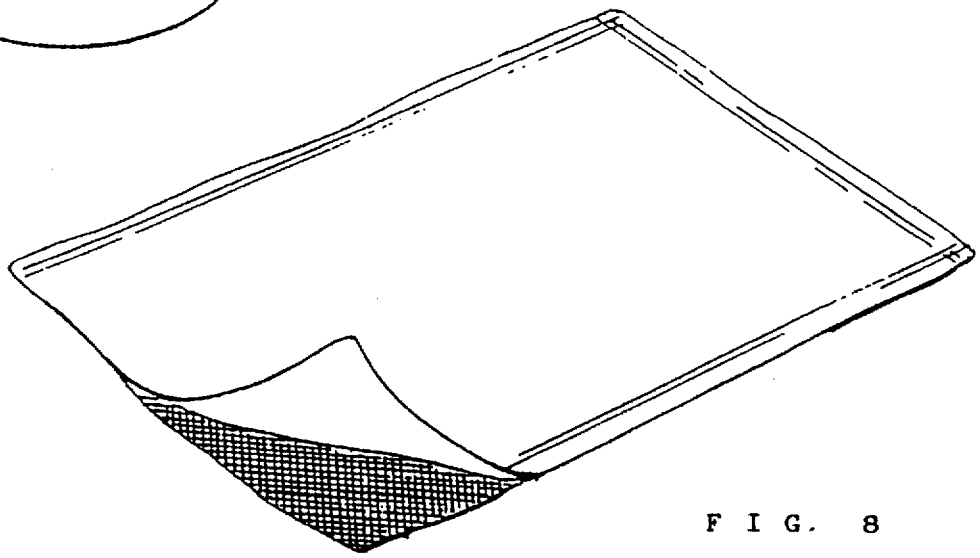
FIG. 8 represents a bag that can be used for the packing under vacuum of products by means of the device according to this innovation.
Figure 6:
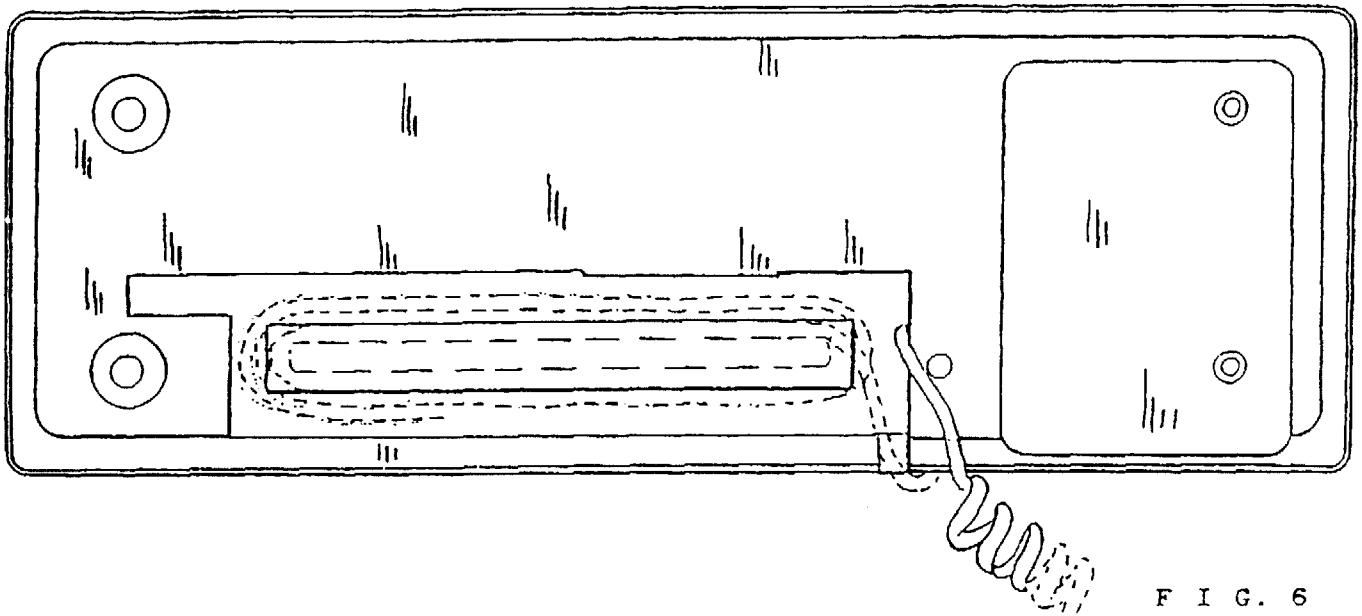
FIG. 6 represents the use of the vacuum generator in order to carry out the packing with a container provided with a valve for the air extraction.

The bags to be used are bags of known type, that present, in correspondence of the opening, wrinkled walls as shown in FIG. 8 or that are anyway provided with a plurality of micro-ribs that allow the air to go through and to be sucked also when the bag walls are pressed one against the other.

Figure 3:
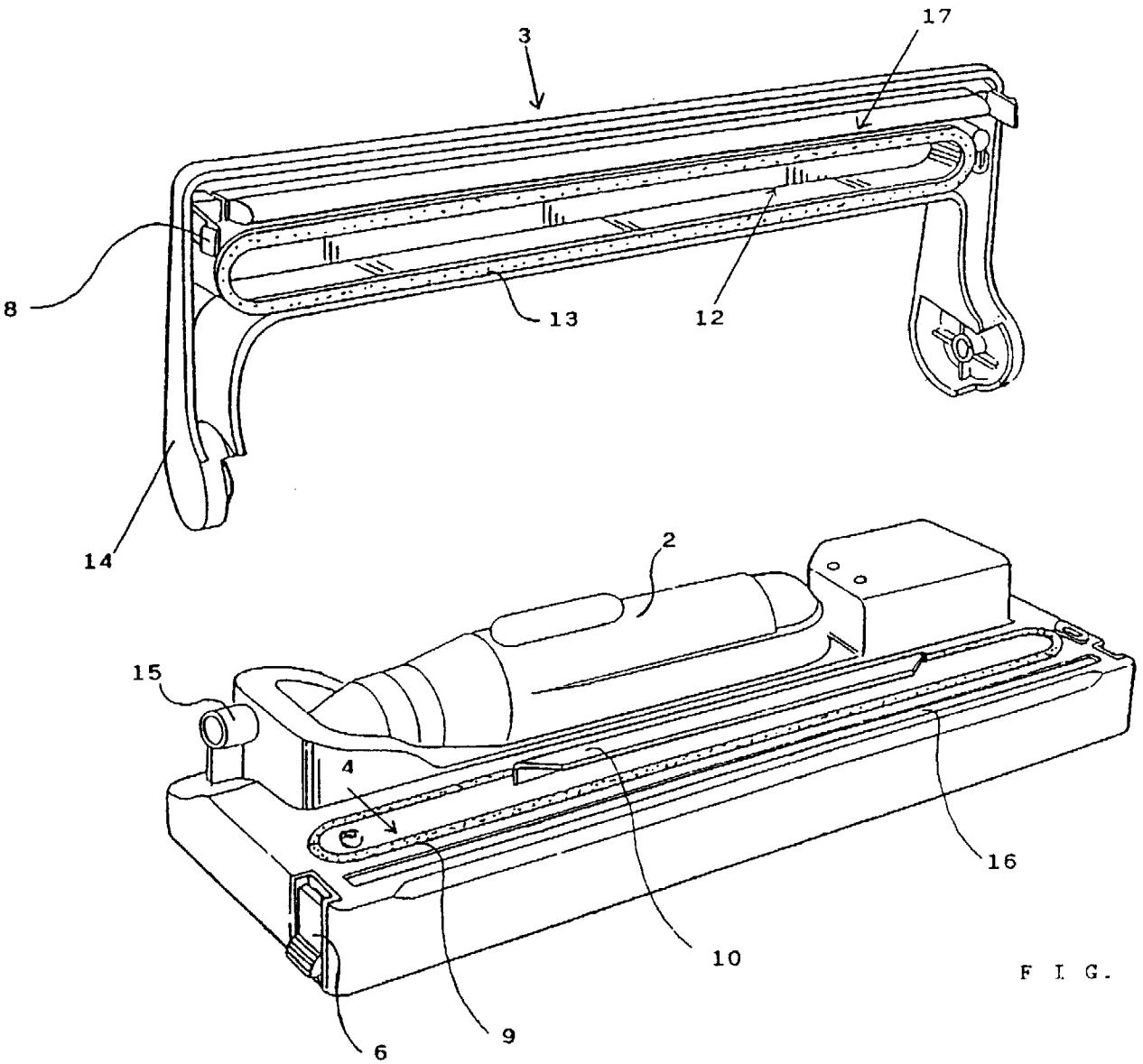
FIG. 3 represents the device in perspective view, with the mobile element in a separated view.
Figure 4:
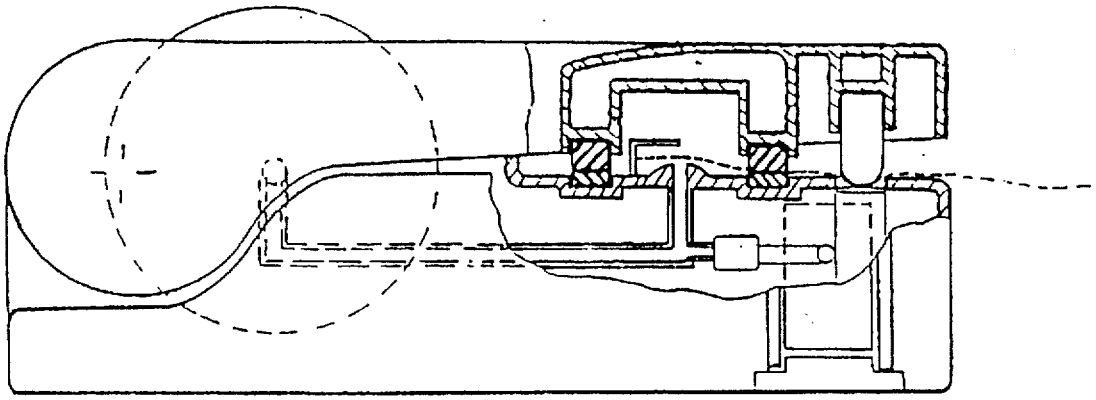
FIG. 4 represents the device, laterally raised and partially in section.

In the base 1 (FIGS. 2 and 3) a chamber is obtained, shown with 4, where a duct 5 ends. This duct is connected, on the opposite end, to a connection where the metal suction point of the suction device 2 is inserted.

The aspirator pump, consequently, is connected, through the duct 5, with the inside of chamber 4.

Figure 5:
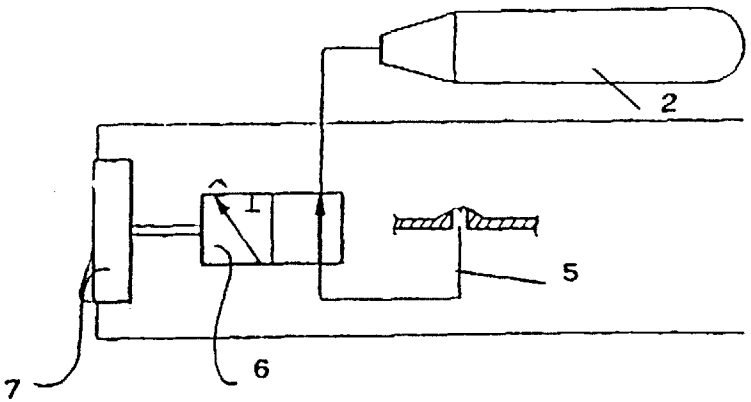
FIG. 5 shows, schematically, the connection of the vacuum generator with the chamber, where the opening of the bag to be packed under vacuum is placed.

On the duct 5 (FIG. 5) also a valve 6 is inserted that allow to put the duct in communication with the outside atmosphere and that is preferably set in action by a push-button 7, located on the side of base 1 and used also to engage a tooth 8 of the cover 3, in order to block it in closed position against base 1.

At the base 1, in correspondence of the edge of chamber 4, an airtight gasket 9 in plastic material is applied.

To the base structure 1, inside the chamber 4, also a wall 10 is fixed, which is intended to act as a striker for the correct positioning of the edge of the bags to be sealed, wall 10 that protrudes superiorly from chamber 4 at a certain distance from the walls of said chamber.

In the cover 3 a chamber 12 is obtained, in a position correspondent to the position of chamber 4, so that, when the cover is closed, the striker wall 10 is inside the area defined by chambers 4 and 12.

Also to the lower edge of chamber 12 a gasket in soft material 13 is applied, that fits together with the gasket 9 when the cover is closed.

The cover is provided with a pair of arms 14 with a shape that allows to insert them, through elastic deformation, around the correspondent pins 15 provided on the base so as to allow the cover to rotate around a substantially horizontal axis for the closure and the opening of it.

According to a possible preferred configuration, suitable to improve the characteristics of compactness of the device, the cover affects only the area of the base that is not occupied by the suction device 2 and the arms 14 are inserted around the seat where this suction device is located.

Always in the base 1 a warming element 16 is located which is formed, for instance, by a blade inside which there is an electric resistance that has the purpose to supply the necessary heat to weld the bag.

In the cover 3, in a position correspondent to the position of the welding blade 16, there is a pressing member 17 built for instance with a bar in a sufficiently rigid material, possibly but not necessarily mounted in its own seat with the interposition of elastic means suitable to exert a controlled pressure of the bag walls against the welding blame 16 when the cover 3 is closed on the base 1.

The use occurs as follow:

once the device with the suction device is prepared in the appropriate seat, the bag to be sealed is put with the open edge in correspondence of the inner area of chamber 4, placing the edge of the bag against the striker wall 10.

At this point the cover is closed with the gasket 13 that leans against the gasket 9, blocking in this way, elastically, with a predefined strength, the walls of the bag one against the other.

At the room temperature the wrinkling or the ribs near the edge of the bag avoid that the bag walls get in narrow contact on the whole surface, allowing in this way the air to filter from inside to outside or viceversa.

The tooths 8 of the cover 3 are engaged by the push-buttons 7 keeping the cover blocked in closed position. It is now possible to set in action the suction device 2.

This latter, through the duct 5 and the valve 6, sucks air from the area limited by chambers 4 and 12 and the depression created causes the air inside the bag to go out through the little openings produced by the wrinkling or ribs on the bag walls.

Once that in the chambers 4 and 12 and then inside the bag a depression is created and then a sufficient vacuum degree, the resistance located in the warming blade 16 is fed and causes the fusion of the bag walls in correspondence of a line located near the edge, sealing it perfectly.

At the end of the operation, that in case can be controlled by a timer or similar, it is sufficient to press the push-buttons 7 to release the cover and at the same time set the valve 6 in action so that the outer air can penetrate into chambers 4 and 12 and re-establish the room pressure.

It is now possible to extract the sealed bag, from the inside of which the air was completely removed.

Figure 7:
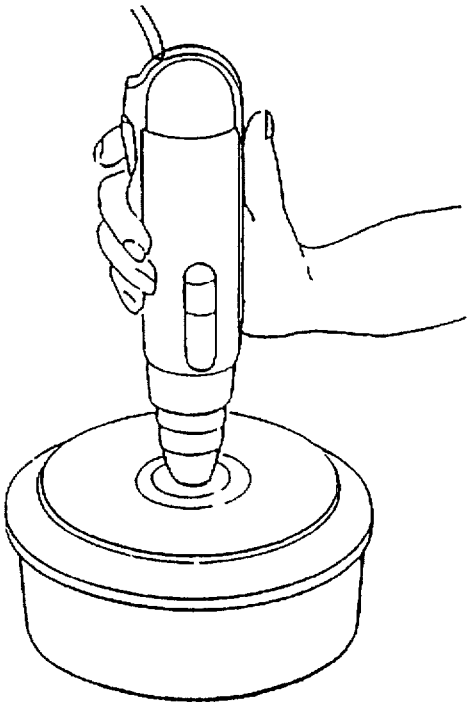
FIG. 7 is a perspective view of the mobile suction device used separately to evacuate a container.

The suction device 2 can, if necessary, be removed to be, in case, used also to create the vacuum inside containers of other types as in FIG 7. Different execution forms of the same solution idea could be provided. For instance, the hinges to connect the cover to the base or the means for hooking to block it in closed position could vary without exiting the protection scope of the innovation.

Also dimensions, as well as used materials, could vary according to the requirements of the use.

I claim:

1. An apparatus for packing products under vacuum in a plastic bag having an opening and wrinkled walls defining micro-ribs for the passage of air to be sucked from the opening, the apparatus comprising:

a base (1) defining a seat for receiving a suction device;

a self-contained suction device (2) removably engaged into said seat, said suction device having a suction point engageable with a container which is separate from said base, to evacuate the container when the suction device is removed from the seat;

first gasket means (9) on said base, defining a first chamber (4) for receiving the bag opening;

a wall member (10) in said first chamber and onto which the bag opening is engageable for holding the bag opening, open;

a warming element (16) on said base (1) spaced from said first gasket means (9) and at a location on said base for engaging across the bag when the bag opening is engaged with said wall member (10);

a cover (3) pivotally mounted to said base (1) for movement between a closed position and an open position;

second gasket means (13) defining a second chamber (12) in said cover (3), said second gasket means being positioned on said cover so that when said cover is in said closed position, said first and second gasket means engage each other to align said first and second chambers to be above and below the bag opening;

a pressing member (17) connected to said cover and spaced from said second gasket means, said pressing member being positioned on said cover so as to be aligned with said warming element (16) when said cover is in said closed position for sealing a bag whose opening is engaged with said wall member;

a duct (5) in said base and connected between said first chamber and said seat, said suction point of said suction device being engaged with said duct when said suction device is in said seat for establishing suction in said duct and in said first chamber when said first and second chambers are engaged with each other in said closed position of said cover; and a manually operated valve (6, 7) connected in said duct and having a first position for communicating said suction point of said suction device with said first chamber and a second position communicating said first chamber with atmosphere for relieving any suction in said first chamber.

2. An apparatus according to claim 1 wherein said manually operated valve includes a push button (7) movably mounted to said base.

3. An apparatus according to claim 2 including a tooth (8) connected to said cover (3) and engageable with said push button (7) for holding said cover to said base in said closed position, when said push button is moved.

4. An apparatus according to claim 1 wherein said first and second gasket means comprise first and second elastic gaskets extending around said first and second chambers respectively.

* * * * *